US005183294A

United States Patent [19]

Jukola et al.

[11] Patent Number: 5,183,294

[45] Date of Patent: Feb. 2, 1993

[54] PRE-ASSEMBLED SOFT COVER FOR A BOOK, AND METHOD OF MAKING THE SAME

[75] Inventors: Bero Jukola, Keuruu, Finland; Werner Rebsamen, Rush, N.Y.

[73] Assignee: Kustannusosakeyhtio Otava, Helsinki, Finland

[21] Appl. No.: 727,241

[22] Filed: Jul. 9, 1991

[30] Foreign Application Priority Data

Oct. 1, 1990 [EP] European Pat. Off. ..... 90202614.5

[51] Int. Cl.[5] ..... B12D 1/00; B12D 3/00

[52] U.S. Cl. ..... 281/23; 281/36; 41/36

[58] Field of Search ..... 281/25, 36, 21.2, 29; 428/190, 195, 347; 412/8, 36-906; 462/900

[56] References Cited

U.S. PATENT DOCUMENTS

| | | | |
|---|---|---|---|
| 951,436 | 3/1910 | Duryen | 281/23 |
| 1,845,612 | 2/1932 | Maddox | 281/23 |
| 1,926,477 | 9/1933 | Elliott | 281/23 |
| 2,219,553 | 10/1940 | Bassett | 281/23 |
| 3,437,506 | 4/1969 | Falberg . | |
| 4,299,410 | 11/1981 | Jukola . | |
| 4,547,000 | 10/1985 | Sullivan | 281/36 |

FOREIGN PATENT DOCUMENTS

| | | |
|---|---|---|
| 0268562 | 5/1988 | European Pat. Off. . |
| 3348128 | 8/1984 | Fed. Rep. of Germany . |
| 8804396 | 7/1988 | Fed. Rep. of Germany . |
| 3811133 | 9/1989 | Fed. Rep. of Germany . |
| 429859 | 6/1935 | United Kingdom . |
| 2184981 | 7/1987 | United Kingdom . |
| WO82/03824 | 11/1982 | World Int. Prop. O. . |

*Primary Examiner*—Mark Rosenbaum
*Assistant Examiner*—Willmon Fridie, Jr.
*Attorney, Agent, or Firm*—Young & Thompson

[57] ABSTRACT

In a method of manufacturing a soft-cover paperback book comprising a book block with a plurality of leaves joined at their spine edges, and a soft-cover fastened to the book block, a flexible, firm support layer is glued to the soft-cover in the region of the spine portion of the soft-cover, and thereafter glueing the plurality of leaves to the support layer. The book manufactured according to this method has a front cover and a back cover provided with a scoring line situated between glue stripes at opposite faces of the support layer for improving its lay-open characteristics. In this method, a pre-assembled soft-cover can be used with a support layer fastened thereto.

1 Claim, 1 Drawing Sheet

PRE-ASSEMBLED SOFT COVER FOR A BOOK, AND METHOD OF MAKING THE SAME

The present invention deals with a method of manufacturing a soft-cover paperback book comprising a book block with a plurality of leaves joined at their spine edges, and a soft cover fastened to the book block. Such a method is known, e.g. from U.S. Pat. No. 4,299,410. According to this known method, books are produced which are user-friendly, i.e. which show good lay-open characteristics. Also, this known method offers an economical production of such books.

On the other hand, for producing books according to this method extensive hardware is required. Furthermore, change-over times from job to job, i.e. for shifting production to another kind of book, are long. Therefore this known method is mainly suitable for long runs, producing large numbers of books at a time.

There is however an existing need for producing the above books with good lay-open characteristics on an economical scale in smaller numbers. For this purpose, the known method loses its economic advantages, due to the high investments needed and the relatively long changeover times.

U.S. Pat. No. 3,437,506 discloses a bookbinding tape comprising an elongated fabric tape with three longitudinal stripes of heat-sealable adhesive thereon, one stripe being located centrally on one side of the tape and having a width approximately equal to the thickness of the pages of the book being bound, and the other two stripes of adhesive being located on the reverse side of the tape adjacent the edges thereon. This tape has uncoated portions between the stripes of adhesive to serve as hinges for the cover of the resulting book.

Such a tape can be used to securely bind a block of leaves to the cover in a one-step operation. However, the tape is fastened only to the spine of the block and is unattached to the front and back leaves of the block. Furthermore, the tape is first fastened to the book block and thereafter to the cover. Such a tape results in a rather poor strength between cover and block of leaves.

The invention is therefore aimed at providing a method for producing books as described above, which is also suitable for production on a smaller scale.

This is achieved by glueing a flexible, firm support layer to the soft-cover in the region of the spine portion of the soft-cover, and thereafter glueing the plurality of leaves to the support layer. The first step of production according to this method, i.e. the glueing of the flexible support layer to the soft-cover may either be carried out manually, semi-automatically or fully automatically, all depending on the tools selected and the funds available for the necessary investments. A cover with a support layer once assembled can be further processed on existing equipment for finishing the work whereby the leaves are glued to the support layer. Also, a change-over from a regular manufacturing job to one wherein the above pre-assembled soft-covers are used, requires no additional downtime of the equipment.

In order to assure good lay-open characteristics, the support layer is glued only to the front cover and the back cover of the soft-cover. If the front and back cover are not fastened to the support layer all the way up to their spine edges, a further improvement with respect to laying open the book may be obtained.

According to a first possibility, this is achieved by applying glue stripes onto the front cover and the back cover at a distance of the spine portion of said soft-cover, and fastening the support layer to the soft-cover by pressing onto the glue stripes.

According to a second possibility, this is achieved by applying glue stripes onto the side edges of the support layer at a mutual distance which is greater than the thickness of the book block, and fastening the support layer with its edges to the front cover and the back cover by pressing onto the glue stripes.

After the soft-cover and support layer have been assembled in one of the above ways, the book is finished by applying a glue stripe onto the face of the support layer facing away from the soft-cover, and glueing the spine edges of the leaves to said glue stripe.

Preferably, the method is further improved by applying the glue stripe for glueing the spine edges of the leaves at such a position that said glue stripe does not overlap the glue stripes for glueing the front cover and the back cover. A book obtained in this way offers good lay-open characteristics. In this respect, it is also advantageous to glue the support layer also to the first and the least leaves of the book block, adjacent their spine edges.

The invention is also related to books produced according to the above method. The lay-open characteristics of such a book are influenced favourably if the front cover and the back cover are provided with a scoring line situated between the glue stripes on opposite faces of the support layer. In this embodiment, the front cover of the book may be laid open without also automatically pulling up the title page, i.e. the first leaf adjacent the front cover. Thanks to this scoring line, no stresses are exerted on the first, most critical pages. A book like this opens like a hard-cover binding. Also, thicker materials may be used for the soft-cover without impairing the lay-open characteristics.

Additionally, the front cover and the back cover may be provided with a second scoring line outside the support layer.

The invention is furthermore related to a pre-assembled soft-cover for use in the method described above. Such a pre-assembled soft-cover is provided with a support layer fastened thereto. It is compact, and may therefore be easily shipped in large numbers. The covers could be produced at one place, and subsequently be distributed for further processing.

As already mentioned, for obtaining good lay-open characteristics the flexible support layer is fastened only to the front cover and the back cover, preferably at a distance from the spine edges of the front cover and the back cover.

Also, the front cover and the back cover are provided with a scoring line situated between the spine edge of the respective cover and its region fastened to the support layer, as well as with a second scoring line situated outside the support layer.

The invention will be described below with reference to the drawings.

Figure 1:
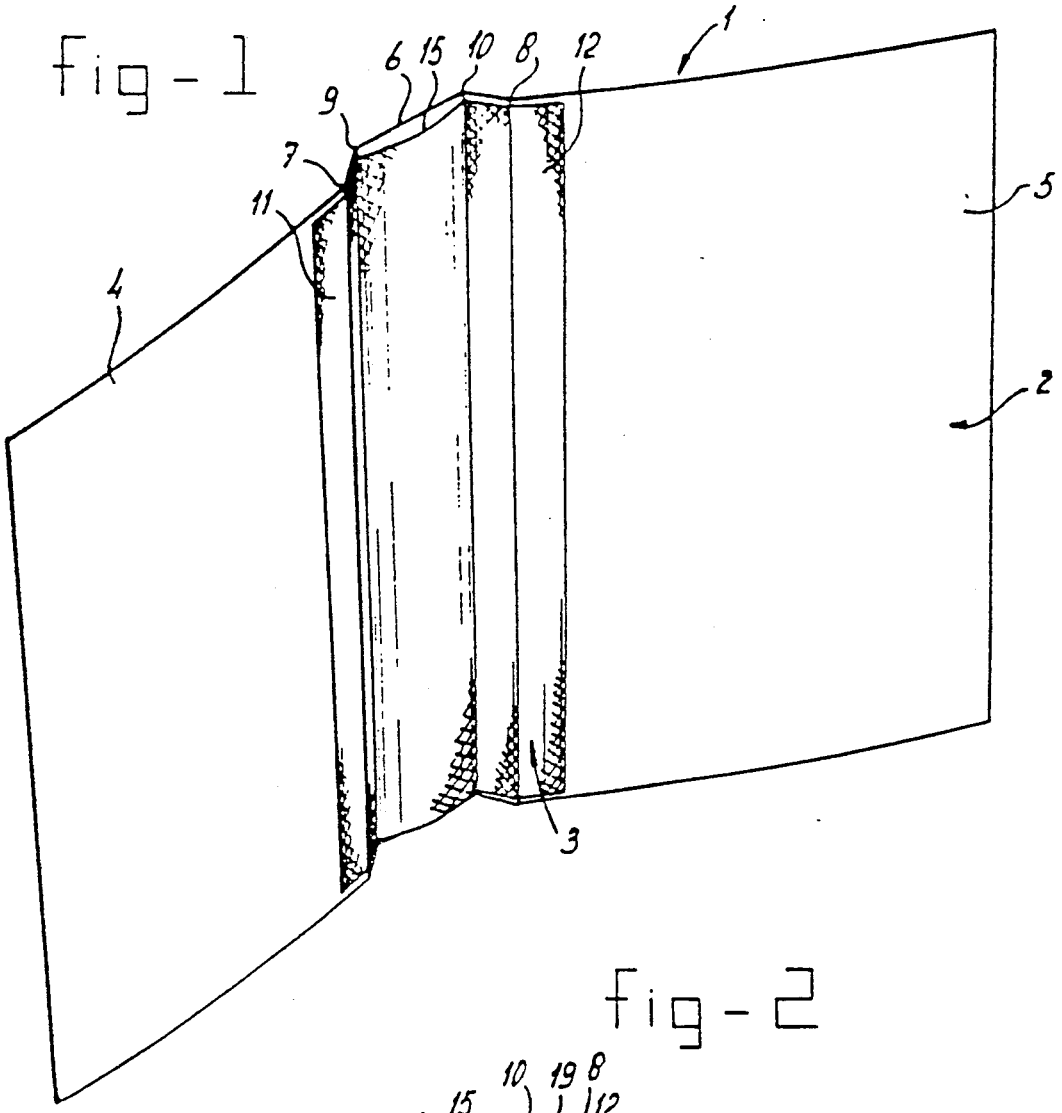
FIG. 1 shows a pre-assembled soft-cover according to the invention, in a perspective view.

The pre-assembled soft-cover 1 comprises soft-cover 2 and a flexible support layer 3 fastened thereto. The soft-cover 2 consists of a front cover 4, a back cover 5, and a spine 6. Front cover 4 contains a scoring line 7, back cover 8 contains a scoring line 8. Furthermore, front and back cover 4, 5 are connected to the spine 6 by scoring lines 9, 10.

The side edges 11, 12 of the support layer 3 are glued to the front resp. back cover 4,5. Between these side edges 11, 12 i.e. between the scoring lines 7, 8 the support layer 3 is loose.

Figure 2:
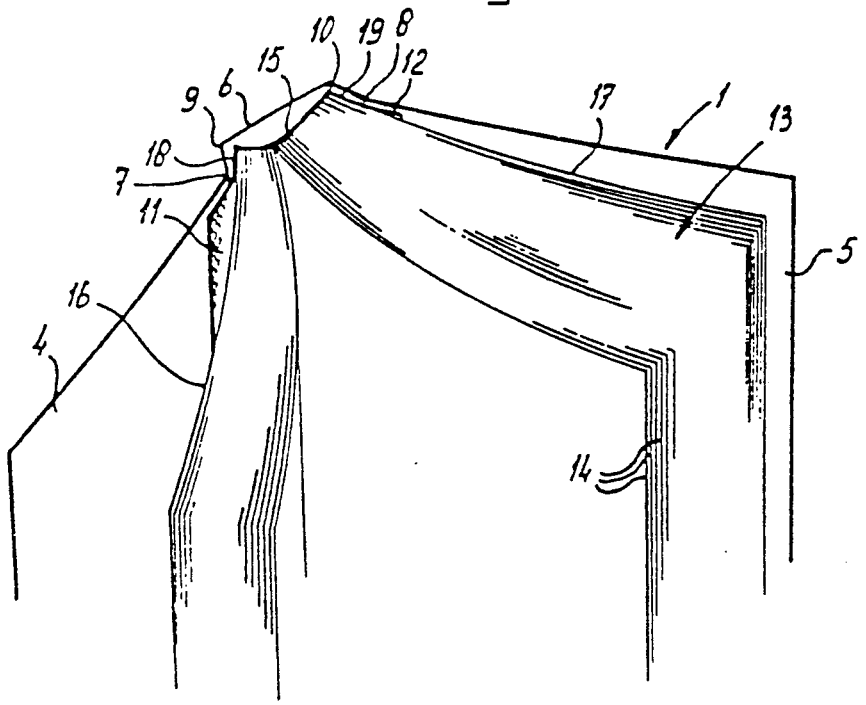
FIG. 2 shows a book according to the invention, in a perspective view.

This loose part of the support layer 3 is attached to a plurality of leaves 13, as shown in FIG. 2. More precisely, the spine edges of the separate leaves 14 are glued to the spine part 15 of the support layer 3, and the first leaf 16 and the last leaf 17 are, near their spine edges, also glued to the parts 18, 19 of the support layer 3.

The parts 18, 19 of support layer 3 are situated between spine part 15 and side edges 11, 12, and are therefore also loose.

Outside the region covered by the support layer 3, the front resp. back cover 4, 5 may be provided with a further scoring line (not shown).

We claim:

1. A pre-assembled soft cover for a book, comprising a soft sheet of book cover of a size and shape suitable to provide a front and rear cover with a spine therebetween, and adhesively secured to a central portion of said sheet a flexible firm support layer in the form of a strip bisecting said sheet and secured to said sheet only by stripes of adhesive along opposite longitudinal edges of said strip, said strip being free from securement to said sheet between said adhesively secured edges of said strip thereby to provide a spine area on said strip between said adhesively secured edges of said strip, said strip being free from securement to any pages of a book, whereby upon subsequent securement, to said spine area, of a book block with a plurality of leaves joined at their spine edges, a soft-cover book can be produced.

* * * * *

UNITED STATES PATENT AND TRADEMARK OFFICE

CERTIFICATE OF CORRECTION

PATENT NO. : 5,183,294

DATED : February 2, 1993

INVENTOR(S) : Eero JUKOLA et al.

It is certified that error appears in the above—identified patent and that said Letters Patent is hereby corrected as shown below:

On the title page: item 75, change the first name of the first inventor, from "Bero" to --Eero--.

Signed and Sealed this

Twenty-sixth Day of October, 1993

*Attest:*

Bruce Lehman

BRUCE LEHMAN

*Attesting Officer*

*Commissioner of Patents and Trademarks*